US005154417A

United States Patent [19]

Kohli

[11] Patent Number: 5,154,417

[45] Date of Patent: Oct. 13, 1992

[54] GOLF TEE

[75] Inventor: Leslie F. Kohli, Criderville, Ohio

[73] Assignee: James W. Crook, Jr., Elida, Ohio

[21] Appl. No.: 757,322

[22] Filed: Sep. 10, 1991

[51] Int. Cl.[5] ..... A63B 57/00

[52] U.S. Cl. ..... 273/33

[58] Field of Search ..... 273/33, 201, 205, 206, 273/212, DIG. 7

[56] References Cited

U.S. PATENT DOCUMENTS

| | | | |
|---|---|---|---|
| 1,633,686 | 6/1927 | Stone | 273/212 |
| 1,679,579 | 8/1928 | Lundy | 273/33 |
| 3,079,158 | 2/1963 | Finn et al. | 273/212 |
| 3,506,263 | 4/1970 | Arrington | 273/33 |
| 3,633,919 | 1/1972 | Liccardello | 273/212 |
| 3,747,927 | 7/1973 | Hoffman | 273/33 |
| 3,884,479 | 5/1975 | Gordor | 273/212 |
| 4,178,406 | 12/1979 | Russell | 273/DIG. 7 |
| 4,787,637 | 11/1988 | Lima et al. | 273/212 |
| 4,893,818 | 1/1990 | Liccardello | 273/212 |

*Primary Examiner*—Mark Graham
*Attorney, Agent, or Firm*—Rueben Wolk

[57] ABSTRACT

A golf tee having a monolithic body made of a tough, resilient, abrasion resistant polymeric material, having a principal cylindrical body portion, a ball supporting portion, and a tapered tip for insertion into the ground. A reinforcing member in the form of a pin approximately the shape of the tee is embedded longitudinally within the body, extending at least within the cylindrical body portion to provide stiffness when the tee is inserted into the ground.

9 Claims, 1 Drawing Sheet

GOLF TEE

BACKGROUND OF THE INVENTION

The present invention relates to a golf tee having a tough, resilient body made of a polymeric material which will not damage the club face upon impact, and has a reinforcing member in the form of a pin inserted longitudinally thereof to provide stiffness so that the tee may be inserted into the ground without breaking or bending.

PRIOR ART STATEMENT

It has been known to make resilient plastic tees which simulate wooden tees in their overall appearance, but which are more permanent because of their composition, and which will not damage a club face. Such tees have the disadvantage of being difficult to insert in the ground without breaking or bending out of shape, due to their resilient composition.

Attempts have been made to overcome this problem by making a tee with a plastic body but having a separate metal tip for insertion into the ground, and a separate ball supporting member at the upper surface, such as shown by a U.S. patent to F. Liccardello, U.S. Ser. No. 3,633,919; and an improvement patent to P. Liccardello, U.S. Ser. No. 4,893,818 in which the separate tip is made of a hard plastic material.

SUMMARY OF THE INVENTION

The invention is directed to a golf tee having a tough, resilient, abrasion resistant monolithic polymeric body and a pin inserted and embedded longitudinally thereof to serve as a reinforcement and permit the tee to be inserted into the ground without breaking or permanently bending. It represents an improvement over the prior art because the body is unitary and thus does not require a separate tip as in the prior art patents referred to above. The tee thus manufactured conforms to the shape of a traditional tee, yet is practically indestructible, will withstand the impact of a golf club, and yet will not damage the face of a wooden driving club.

The body has a ball-supporting upper surface and is generally cylindrical, tapering to a pointed tip for insertion into the ground, and in this respect is similar to a conventional wooden or plastic tee. However, the key to easy insertion without bending or breaking lies in the use of a solid or hollow tubular cylindrical pin which is slightly smaller in diameter than the cylindrical portion of the body, and is incorporated along the longitudinal central axis of the body. The pin extends from just below the upper ball-supporting surface to at least the beginning of the tapered tip, or slightly beyond it. It should be noted that the use of an insert is known, as shown in U.S. Pat. No. 4,787,637 issued to Lima et al, although in that patent the tee is made of wood, and has a graphite insert with an upper surface which supports the ball, and only extends a short distance into the body of the tee. The purpose of the insert is to serve as a compression member which stores the energy of the ball when it compresses under impact, then returns the energy when the ball leaves the tee.

It is a primary object of this invention, therefore, to provide a golf tee made of a polymeric material having a longitudinal reinforcing pin to permit the tee to be inserted in the ground without breaking or bending.

It is a further object to provide a tee which is practically indestructible.

It is another object to provide such a tee which will not damage a club surface.

It is another object to provide a tee made of a tough, flexible, abrasion-resistant material having reinforcing means to accomplish the above objects.

It is another object to provide a tee which is economical to manufacture.

Other details, features and objects of the invention will become apparent from the embodiments described herein.

DESCRIPTION OF THE PREFERRED EMBODIMENTS

Figure 1:
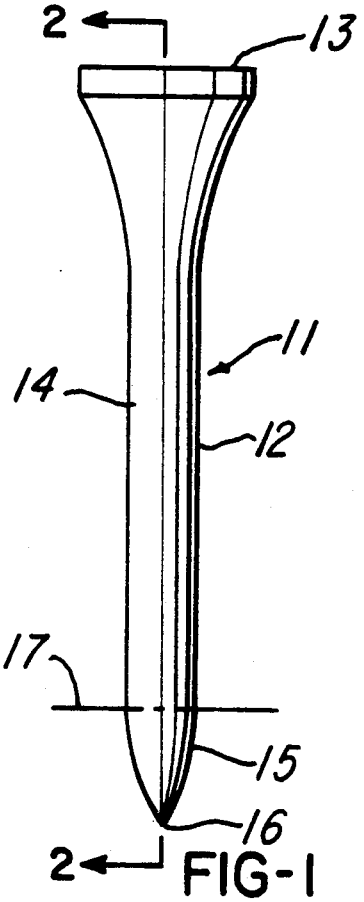
FIG. 1 is an elevational view of the novel golf tee.
Figure 2:
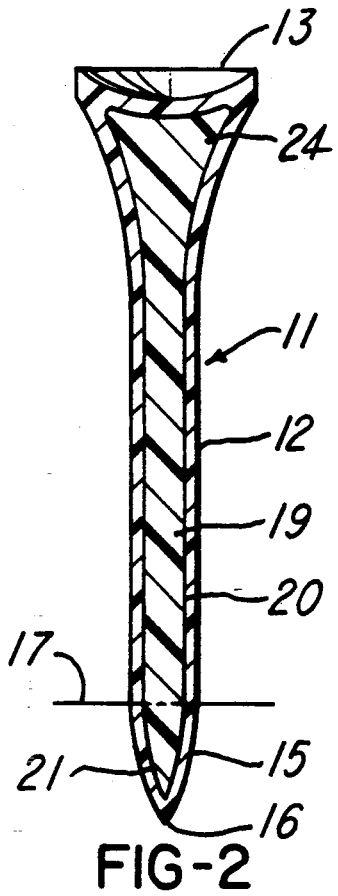
FIG. 2 is a cross-sectional view of the tee, taken along lines 2—2 of FIG. 1.

Referring now to the drawings, FIGS. 1 and 2 illustrate a preferred form of the novel tee 11, comprising the principal body member 12 which has an outwardly curved ball-supporting surface 13. The major portion of the body member is cylindrical in cross-section, having a diameter of about 3/16 of an inch, this portion designated by reference number 14. This cylindrical portion tapers inwardly at plane 17 to form the tip portion 15, terminating in the sharp tip 16. The body member is monolithic and is formed of a tough, resilient abrasion-resistant polymeric material. Plastic materials are preferred, one example being an ionomer resin sold by Dupont under the Trademark "Surlyn 5920" having a notched izod toughness rating of about 1200, and is the same material which is favored for making the covers of golf balls. Other plastic materials having similar characteristics are any of the polyolefins, the styrenics the vinyls, or urethane elastomers. Elastomeric materials such as butadiene or other synthetic rubbers may also be used, selecting those formulations which provide the desired characteristics. All these materials are relatively inexpensive, and readily accept a wide range of colors. As pointed out above, these materials have a permanence that makes the tee practically indestructible, and will not damage a golf club upon impact.

As indicated above, a tee made of this material alone would be difficult to insert into the ground without causing it to break or bend greatly, even to the point of permanent deformation. This problem has been overcome by the use of the pin 19 which is incorporated longitudinally of the body, centered along the longitudinal axis. The configuration of the pin is primarily cylindrical, the cylindrical portion being designated by reference number 20, and has a diameter of between 1/16 and 1/8 of an inch. The upper portion or butt end of the pin has an outwardly curved body 24 whose surface is approximately parallel to and spaced from the ball supporting surface 13 of the body, and the lower portion of the pin tapers inwardly at plane 17 to form a tip 21 which is approximately parallel to and spaced from the tip 16 of the body. The pin is thus fully embedded or encapsulated within the body 12, and extends from just below the upper surface 13 along the major extent of the cylindrical portion 14 of the body, and partially into the tip portion 15 terminating short of the tip 16.

Figure 3:
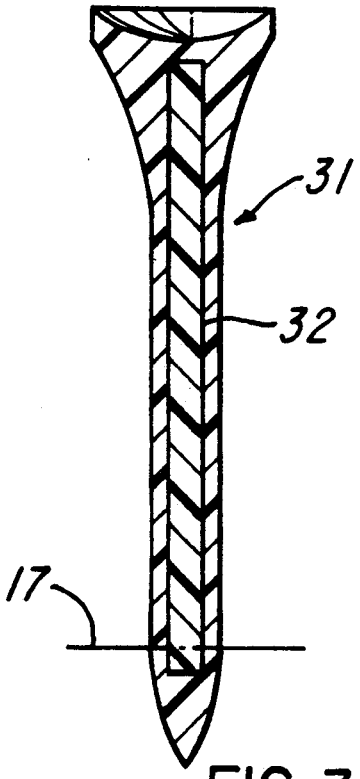
FIGS. 3 and 4 are cross-sectional views of modified forms of the invention.

FIG. 3 illustrates a modified form of the invention comprising a tee 31 having a somewhat shorter pin 32 which is completely cylindrical, extending from just below the ball supporting surface 13 to just beyond the plane 17 which defines the area at which the tip taper begins, but does not have the tapered shape similar to tip 21.

Other modified forms of the invention are also contemplated. For example, the pin may have an outwardly curved body similar to body 24 of pin 19 shown in FIG. 2, but instead of tip 21, the lower portion may be cylindrical, as in pin 32 of FIG. 3. Another modification may provide a pin having a tip portion similar to tip portion 21 of FIG. 2, but instead of the outwardly curved body 24, the upper portion may be cylindrical as in the pin 32 of FIG. 3. In each form of the invention, best results are achieved when the pins have a length which is between 70 and 90 percent of the length of the tee.

The pins 19 and 32 are made of a material which is considerably stiffer than the body of the tee, and may be formed of the material commonly known as fiberglass, which consists of glass fibers embedded in a resin, such as a pultruded rod having a tensile and a flexural strength of about 120,000 psi each. Other materials which may be used are composites of carbon or graphite fibers embedded in epoxy or other resins, or metal. Although the pins illustrated are shown with smooth outer surfaces, they may instead have longitudinally extending flutes, or have radial or spiral corrugations to improve the encapsulation.

Figure 4:
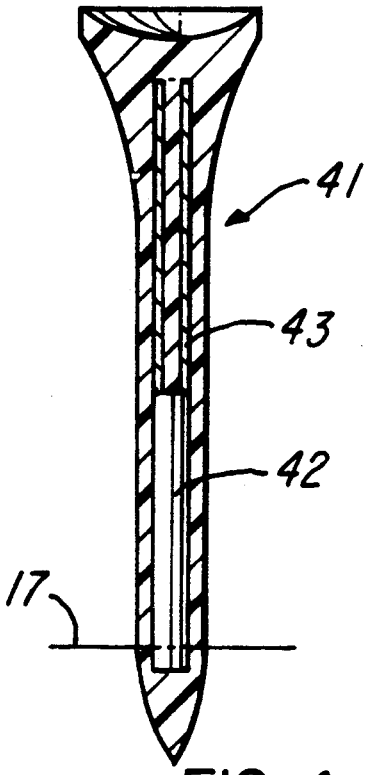

As shown in FIG. 4, a tee 41 may have a pin 42 which is tubular in construction, having walls 43. The pin is open at both ends, permitting the body material to enter into the open center 41 of the pin. The pin 42 may be made of the same materials as pins 19 and 32, and will provide the desirable stiffening effect.

The tee may be made by conventional molding processes, such as injection or compression molding, wherein the pin is encapsulated within the body during the molding process.

Other forms of the invention are also contemplated as falling within the spirit of the invention

I claim:

1. In a reusable golf tee for insertion into the ground, comprising a tee body having a major cylindrical portion thereof tapering inwardly to a lower tip portion having a sharp tip, and flaring outwardly to a curved ball supporting portion having a ball supporting upper surface; the improvement wherein said tee body is monolithic and has a longitudinal central axis and is made of a tough, resilient, abrasion resistant polymeric material, said tee body having reinforcing means for providing stiffness along said axis, said reinforcing means consisting of a separate member fully imbedded within said tee body and coaxial therewith, said member extending into said ball supporting portion from just below said upper surface and extending into said tip portion and terminating short of said tip, said member permitting said tee to be inserted vertically into said ground without breaking or bending, wherein said member has a butt end having an outwardly curved body, said button end having a surface approximately parallel to and spaced from said ball supporting surface of said tee body.

2. The golf tee of claim 1 wherein said member is a pin having a cylindrical configuration over at least a major portion of its length and extending throughout at least the cylindrical portion of said tee body.

3. The golf tee of claim 2 wherein said pin extends between 70 and 90 percent of the length of said tee.

4. The golf tee of claim 3 wherein said pin has a tapered tip approximately parallel to said tee body tip portion.

5. The golf tee of claim 2 werein said pin is made of a material having greater stiffness than said tee body.

6. The golf tee of claim 2 wherein said pin is made of fiberglass.

7. The golf tee of claim 2 wherein said pin is made of a resinous material having fibers imbedded therein.

8. The golf tee of claim 2 wherein said pin is made of metal.

9. The golf tee of claim 1 wherein said tee body is made of an ionomer resin.

* * * * *